United States Patent [19]

Spitz

[11] 4,437,197

[45] Mar. 20, 1984

[54] FOLDING SOFA-BED MECHANISM

[75] Inventor: Melvin P. Spitz, Beverly Hills, Calif.

[73] Assignee: Kinematic Industries, Inc., Whittier, Calif.

[21] Appl. No.: 322,337

[22] Filed: Nov. 18, 1981

Related U.S. Application Data

[63] Continuation-in-part of Ser. No. 264,269, May 18, 1981, Pat. No. 4,398,311.

[51] Int. Cl.[3] ..... A47C 17/14

[52] U.S. Cl. ..... 5/13; 5/57 E

[58] Field of Search ..... 5/13, 57 B, 57 E, 17, 5/18 R, 51 R, 28, 29

[56] References Cited

U.S. PATENT DOCUMENTS

| | | | |
|---|---|---|---|
| 992,674 | 5/1911 | Klopping | 5/57 E |
| 1,276,859 | 8/1918 | Bair | 5/57 E |
| 1,622,451 | 3/1927 | Kroschel | 5/57 E |
| 2,853,717 | 9/1958 | Firsel | 5/17 |
| 3,710,402 | 1/1973 | Eakins | 5/13 |
| 3,934,281 | 1/1976 | Brindisi | 5/13 |
| 4,104,745 | 8/1978 | Pacitti | 5/13 |

*Primary Examiner*—Alexander Grosz
*Assistant Examiner*—Michael F. Trettel
*Attorney, Agent, or Firm*—Whann & McManigal

[57] ABSTRACT

A folding bed frame for sofa-beds in which a plurality of frame sections, including a foot section, knee section, body section and head section are pivoted in end-to-end relation so as to be foldable between an extended bed-forming position and a retracted sofa seat-forming position; wherein front and rear support and guiding link assemblies coact to control movements of the body section and head section during movements to the extended bed-forming position and to the retracted sofa seat-forming position. The link assemblies are supported by a pivoted front anchor link and a rear rocker lever anchor link, which are interconnected by a control link. The mounting arrangement operates to move the frame sections, during folding and unfolding operations, through a path having greater floor clearance, and thus permits a number of advantageous changes such as increased bed length and greater depth of the space for the folded mattress, while still utilizing the restricted dimensions dictated by the furniture framing structure. By a further modification in which the head section is constructed as two sections instead of a single section it is possible to obtain a still greater bed length. The two sections of the head section are capable, in the folded position of the mechanism, of occupying a limited angular orientation permitting them to occupy the confined back area of the sofa frame structure.

15 Claims, 15 Drawing Figures

FIG. 3.
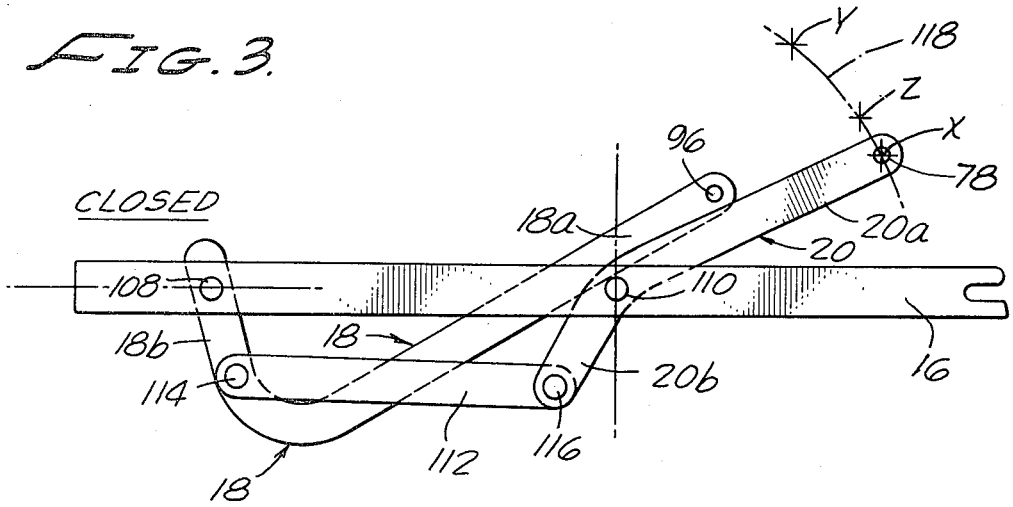
FIG. 4.
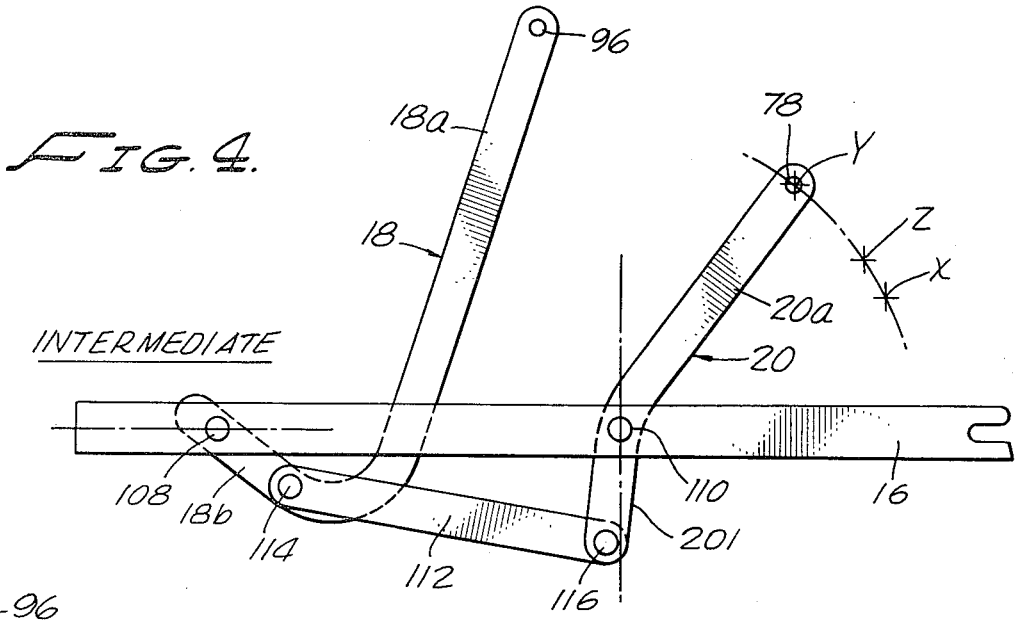
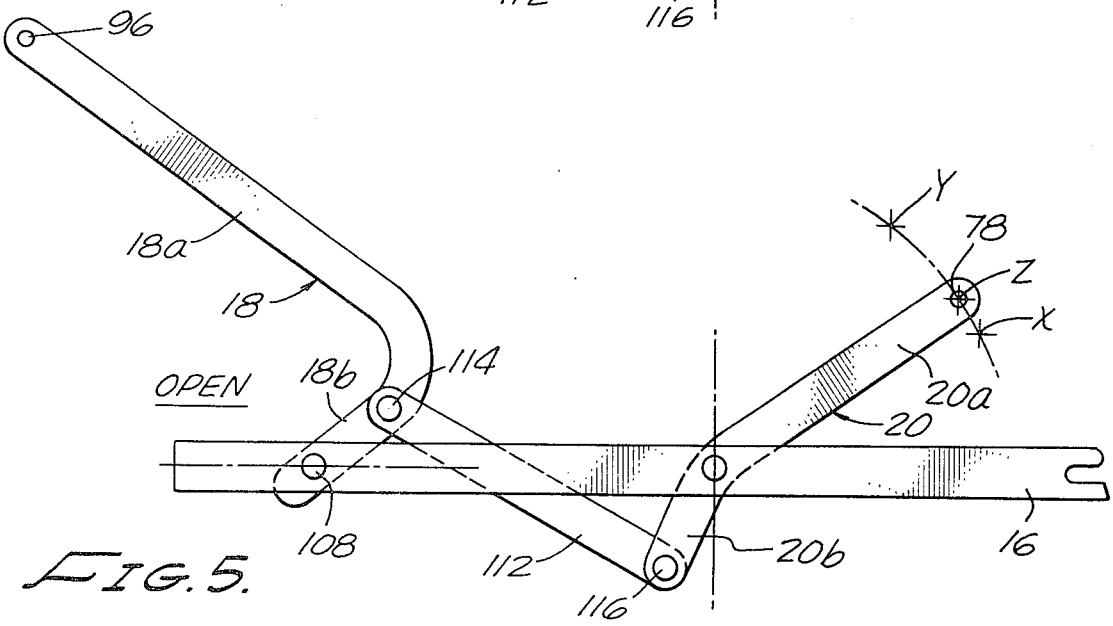
FIG. 5.

FOLDING SOFA-BED MECHANISM

CROSS REFERENCE TO RELATED APPLICATION

This application is a continuation-in-part of my application entitled FOLDING SOFA-BED MECHANISM, Ser. No. 264,269, filed May 18, 1981, now U.S. Pat. No. 4,398,311.

BACKGROUND OF THE INVENTION

The present invention relates generally to the field of articulated bed frames.

It has been generally known heretofore from a number of known arrangements to provide sofa-bed structures in which pivotally connected bed sections could be selectively actuated into an extended bed-forming position or into a sofa seat-forming position. Exemplary of these constructions is the arrangement disclosed in the Spitz, et al U.S. Pat. No. 3,868,733 which discloses a plurality of frame sections, including a foot section, knee section, trunk section and head section pivoted in end-to-end relation, the trunk section being supported upon forward and rearward support assemblies, and the head section being operatively connected through a linkage mechanism such that during folding and unfolding operations of the bed frame, the head section will be moved so as to occupy a substantially horizontal position when the bed frame sections are in a bed-forming position, and a substantially vertical position when the bed frame sections are moved into a sofa seat-forming position.

Characteristic of the foregoing embodiments is the utilization of a front guiding link assembly for the trunk section which is pivotally connected with the upper end of a front upstanding anchor link having its lower end pivoted at a front pivot point on a stationary anchor frame plate. A rear guiding link assembly for the trunk section is also pivotally connected with the upper end of an upstanding fixed rear bracket attached to and extending above a rear end portion of the stationary anchor frame plate.

Other patents have also been known, as exemplified by the disclosure in the Mikos U.S. Pat. No. 3,516,096 in which pivoted front and rear support links are interconnected by a control link on the same side of the respective bottom pivots of the front and rear support links. This control link in effect ties the support links together so that they are operatively maintained in substantially parallel relation and so that their pivotal movements will always be in the same direction.

Another known concept for the mounting of pivotally swingable front and rear support links or levers is that exemplified by the arrangement disclosed in the Mikos U.S. Pat. No. 4,253,205 in which the rear support lever means has a movable supporting pivot, and the control link means, which are connected between the front and rear support lever means are operable to control the movement of the rear support lever means as the bed frame is moved between extended and retracted positions. In the disclosed arrangement, two control links are utilized. One link interconnects the front and rear support levers in a manner similar to that disclosed in the above mentioned U.S. Pat. No. 3,516,096 while the other link is connected to the movable supporting pivot of the rear support lever and acts to movably shift its position forwardly and rearwardly along a horizontal slot in the mounting frame member.

From a careful consideration of the best known linkage mechanisms in the folding bed-sofa art, and in particular the arrangements disclosed in the patents as previously noted above, it became apparent that the currently known structures could advantageously be improved in a number of areas, and in particular that such improvements should preferably include the following objectives:

A. To increase the floor clearance of the frame sections during their articulated folding and unfolding movements;

B. To lower the rear portion of the closed bed frame in relation to the floor; and C. To dispose the extended open bed frame at a more desirable position forward of the associated upholstered back-rest, and at a more desirable height above the floor.

By achieving these objectives, two improved new product features are susceptible of attainment, namely:

1. The length of the open bed can be increased, while at the same time retaining the articulated movements of the mechanism within the restricted and confined dimensions dictated by the associated furniture frame structure.
2. The depth of the space provided within the folded frame structure for the folded mattress can be increased, while at the same time retaining a relatively low seat level with the desired rake or pitch.

In the present invention, these objectives and product features are made possible by the provision of unique coacting front and rear pivoted anchor links for controlling movements of the articulated bed frame sections during the folding and unfolding operations. For such purpose, the front anchor link is pivoted at its inner end at a front pivot point on an anchor frame plate. The rear anchor link comprises a rocker lever which is pivoted between its inner and outer ends at a rear pivot point on the anchor frame plate. A control link coordinates the movement of the front and rear anchor links, this control link being connected at one end to the front anchor link at a point adjacent its mounting pivot, and at its other end to the end of the rear anchor link that extends below its mounting pivot. As thus arranged, movement of the front anchor link, during movement of the frame sections between their fully folded and fully unfolded positions will cause the rear anchor link to successively move in one direction to carry the connected frame sections from a relatively lower elevation to an increased elevation, and then by a reversed direction of movement return the frame sections again to a relatively lower elevation.

In a further modification, greater bed length is obtainable over that just previously described by a unique arrangement in which the length of the head section is increased by fabricating it into two pivotally interconnected sections which combine to provide a head section of greater length than is possible with the previously described single section head section.

In the modified form, the two sections are articulated for controlled translatory movement between an extended unfolded bed-forming position in which the sections are in coplanar relation, and a folded retracted seat-forming position during which the two sections of the head sections assume a limited angular relationship that enables their accomodation within the confining cavity along the back of the sofa frame structure.

SUMMARY OF THE INVENTION

The present invention relates generally to beds of the type having an articulated sectional bed frame, and more particularly to an improved linkage mechanism for actuating and controlling swinging movements of the bed frame sections as they are moved between a bed-forming and a sofa seat-forming position.

Among the various objects of the herein described invention, it is one object to provide a unique arrangement in which opening and closing movements of the frame sections will be controlled by interconnected coacting pivotally supported front and rear anchor links in such a manner as to provide greater floor clearance, and thereby enable modification of the frame sections in a manner to provide bed structures of longer length than heretofore possible.

A further object is to provide an improved support for an articulated bed frame, which will enable increasing of the depth of the space for the folded mattress, while still utilizing the restricted dimensions dictated by the associated furniture framing structure.

Another object resides in the provision of an improved support for an articulated bed frame structure in which the folding and unfolding movements are controlled by coactingly interconnected pivotally supported front and rear anchor links, and in which the rear anchor link constitutes a rocker type lever.

Still another object is to provide a folding sofa-bed mechanism in which increased bed length is obtained by a unique head section in which the head section is fabricated into two pivotally articulated sections of greater overall length, and which are controlled so as to assume a limited angular relation in the sofa seat-forming position while still enabling their accomodation in the limited confines along the back of the sofa frame structure.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 3 is an enlarged fragmentary side elevational view illustrating the relative positions of the front and rear anchor links, and connecting control link, when the frame sections are in a retracted, closed position;

FIG. 4 is a similar view indicating the relative positions of the links at an intermediate operative position of the frame sections;

FIG. 5 is a similar view illustrating the position of the link elements, when the frame sections are in a fully extended open position;

DESCRIPTION OF THE DISCLOSED EMBODIMENTS

Figure 1:
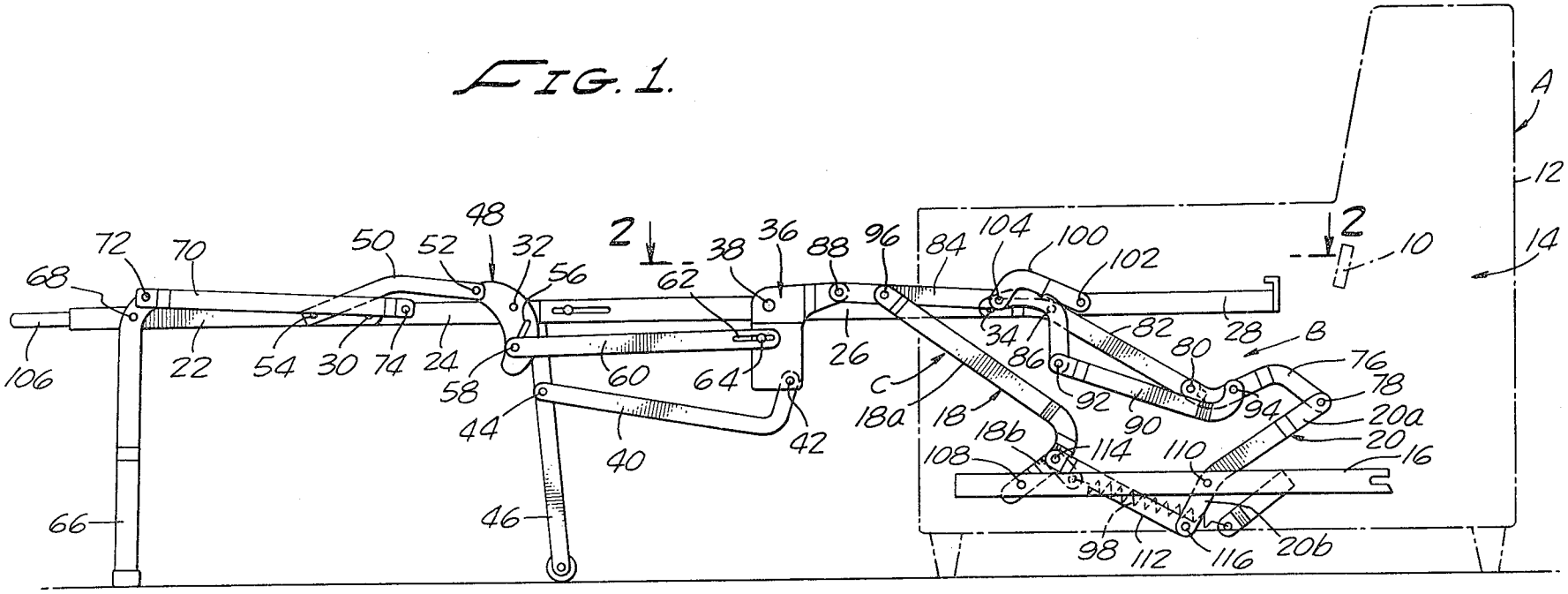
FIG. 1 is a side elevational view of a sofa-bed construction having a bed frame operatively controlled in accordance with the features of the present invention.

Referring more specifically to the drawings, the sofa-bed structure embodying the features of the present invention, as shown in FIG. 1, embodies a linkage actuating and control arrangement generally similar to that disclosed in the Spitz et al., U.S. Pat. No. 3,868,733, and which has been modified as will hereinafter he explained more fully so as to incorporate the features of the present invention. This patent is incorporated in the present application by reference.

The bed frame structure is arranged to be mounted in a conventional upholstered sofa structure as generally indicated in phantom lines at A. Such sofa structure usually comprises opposite end portions that are associated with a fixed wooden frame having a rearwardly spaced back center rail member 10 below and back of which certain parts of the articulated bed frame structure must be moved, when the bed frame is folded to a seat-forming position. The back center rail member is forwardly spaced with reference to a back wall 12 of the sofa structure and cooperates therewith to form a behind-the back-rail space generally indicated at 14 and into which certain parts of the bed frame structure will be received, when in fully folded seat-forming position, as will hereinafter be more fully explained.

The folding sofa-bed structure of the present invention includes, on each side, a fixed end frame structure in which a main horizontal frame member 16 of conventional construction is fixedly secured. This frame member, together with a pivotally supported front anchor link 18 and a pivotally supported rear anchor link 20 constitute a supporting base for appropriate linkage assemblies for interconnecting the bed frame structure with the sofa and guiding the movements of certain portions thereof during folding and unfolding operations of the bed frame structure.

As further shown in FIG. 1, the bed frame comprises a plurality of generally rectangular folding sections identified by their side rails, namely, a foot section 22, knee section 24, body or trunk section 26 and head section 28. These sections are connected in end-to-end articulated relation by joint pivots as indicated at 30, 32, and 34 (FIG. 2), respectively. The side rails of the sections and the operative linkage mechanisms are the same and duplicated on opposite sides of the bed frame structure. In the following description, reference will be made to one side only.

The actuating mechanism for the foot and knee sections, as well as the supporting legs, is conventional and includes a bell crank 36 which is rotatably supported at its elbow on the trunk section 26 by a fulcrum pin 38. One end of an actuating link 40 is pivotally connected at 42 to one end of the bell crank. The other end of the link 40 being pivoted at 44 to a folding leg 46 having its inner end hingedly supported on the body section 26.

A second bell crank 48 is fulcrumed on the joint pivot 32 at the connected ends of the knee section and the body section. One end of a locking link 50 is pivoted at 52 to one arm of the bell crank 48, while the other end is pivoted at 54 to the side rail of the foot section 22 in spaced relation to the joint pivot 30. The other arm of the bell crank 48 is formed with an elongate slot 56 to slideably receive a connection pin 58 at one end of a link 60, the other end of this link being provided with a longitudinal slot 62 for slideably receiving a pin 64 on the bell crank 36.

The foot section of the bed frame is supported in its extended position upon an end leg 66 which is pivoted inwardly of its upper end at 68 to the foot section 22, and an actuating link 70 has one end pivoted at 72 to the upper end of link 66, and its other end pivoted at 74 on the knee section 24 in spaced relation to the joint pivot connection 30.

During the folding and unfolding operations of the bed frame structure, the movements of the body section 26 and head section 28 are controlled by means of conventionally associated linkage systems which comprise a rear support linkage assembly B and a front support linkage assembly C. The rear linkage assembly B comprises a rear hanger link 76 which has one end pivoted at 78 at the outer end of the rear anchor link 20, and its other end pivoted at 80 to one end of a rear support link 82, this link having its other end pivotally connected with the joint pivot 34, as best shown in FIG. 2, connecting the body section and head section.

The front support linkage assembly comprises a coordinating link 84, which is pivoted between its ends at a pivot point 86 to the rear support link 82 for relative swinging movement. One end of the coordinating link 84 is connected by a pivot 88 to the outer end of the upper arm of the bell crank 36, and at its other end, which is in right angled relation, is connected with a second link 90 by pivot connection 92. At its other end, the link 90 is connected by a pivot 94 which is inwardly spaced from the pivot 80 at the outermost end of the rear hanger link 76. The outer end of the front anchor link 18 is pivoted at 96 to the coordinating link 84 at a point inwardly adjacent to its pivotal connection 88 with the bell crank 36.

The connected end portion of the link 84 and the bell crank 36 thus become operative elements of the front support linkage assembly C, and the interconnecting links 84 and 90 cooperate to form coordinating connecting means between the rear support linkage assembly B and the front support linkage assembly C, and determine the path of movement of the body frame section in a conventionally known manner during folding and unfolding operations thereof. A tension spring 98 connects at one end with the front anchor link 18 and is anchored at its other end to the horizontal frame member 16. This spring operates in a manner well known in this type of bed construction and is provided to assist the operator in moving the bed frame from the folded seat-forming position to the extended bed-forming position.

Figure 2:
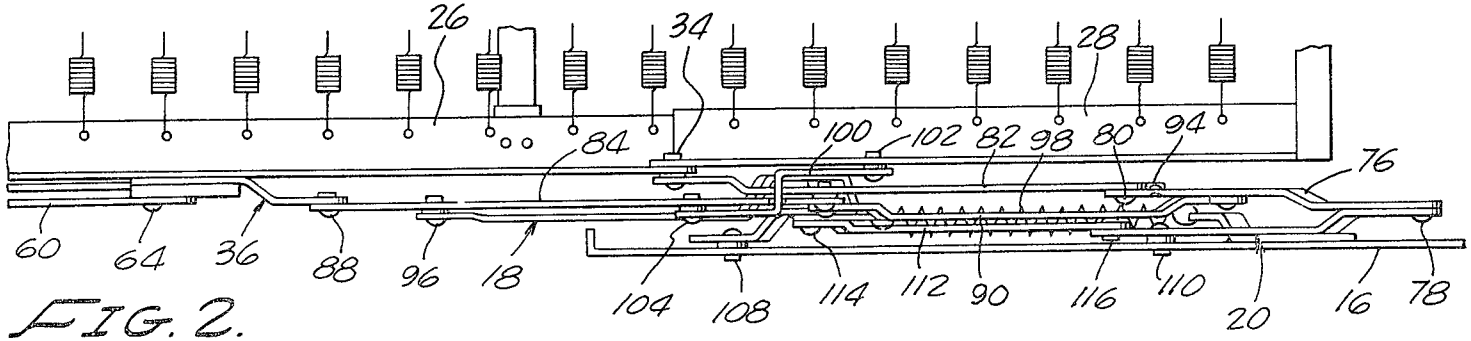
FIG. 2 is an enlarged fragmentary top plan view showing the pivotally connected head section and body section, together with details of the associated actuating linkage mechanism.

Movement of the head section 28 is coordinated with the movements of the body section as determined by the front support linkage assembly and the rear support linkage assembly, by providing a head section actuating link 100 having one end connected to the head section rail at a pivot point 102 which is spaced from the pivot connection 34 of the head section to the body section, as best shown in FIG. 2. The other end of the actuating link 100 is connected by a pivot 104 to the coordinating link 84 at a point spaced from its pivot point 86.

As thus far described, the linkage mechanism is conventional and conforms generally to that disclosed in the Spitz, et al., U.S. Pat. No. 3,868,733, and which coacts to control the movements of the foot and knee sections, and to fold the legs 46 and 66 during folding and unfolding movements of these sections by an operator first grasping a crossbar 106 at the outermost end of the foot section to fold the foot and knee sections into their retracted positions, and by thereafter grasping a crossbar (not shown) transversely connected to the knee section side rails, and by a lifting and closing movement move the bed structure into the sofa frame.

In the present invention, operative objectives and product features are susceptible of attainment by modifying the structures of the front anchor link 18, the rear anchor link 20, and in the provision of unique means for coordinating the action of these elements during folding and unfolding movements of the frame sections.

As best shown in FIGS. 1 and 3–5, the front anchor link 18 is disclosed as comprising a generally L-shaped lever in which a long leg-portion **18*a* is connected at its outer end by the pivot 96 to the coordinating link 84, and a generally right angled short leg-portion 18*b* is connected at its outer end to the forward end of the horizontal frame member 16 at a front pivot point 108. The rear anchor link 20 comprises a rocker lever which is pivoted between its ends upon the horizontal frame member 16 at a rear pivot point 110 which is substantially horizontally aligned with the front pivot point 108. The rear anchor link 20 has a relatively long arm 20*a* which is pivotally connected at its outer end by the pivot 78 with the rear hanger link 76, and a relatively shorter oppositely extending arm 20*b*. The operative movements of the front anchor link 18 and rear anchor link 20 are coordinated and controlled by a connecting link 112 which is connected at one end by a pivot 114 to the short leg 18*b* at a point inwardly of the front pivot point 108. The other end of the connecting link 112 is connected to the outer end of the arm 20*b* by a pivot 116**.

Referring more specifically to FIGS. 3, 4 and 5, the unique operating characteristics of the front anchor link 18, rear anchor link 20 and connecting link 112 will now be described with respect to the movement of the frame sections between folded and unfolded positions and with particular reference to the oriented positions of these elements in the closed, intermediate and open positions of the frame sections.

In general, it will be seen that the configuration of the front anchor link 18, the rear anchor link 20 and the operative connections of the connecting link 112 are such that during the movement between open and closed positions of the bed frame, the pivot 114 will move through a dead center or maximum throw position on one side of a horizontal locus line through the front pivot point 108 to the other side thereof. Also, that during such movement, the long arm 20*a* of the rear anchor link 20 will be moved so that its outer end pivot 78 will traverse an arcuate path 118, as shown in phantom line. This path of movement is disposed entirely on one side of a vertical locus line through the rear pivot point 110. As thus arranged, it will be seen that the rear portion of the bed hangs from the pivot 78 when the bed frame sections are in closed position, and extends forward from the pivot 78 when in opened position. The forward portion of the bed hangs from pivot 96 in both closed and opened positions.

This arrangement provides a unique controlled movement of the pivot point 78 of the rear anchor link 20 in which it will be seen that by selectively locating the pivot 114 on the leg-portion 18*b* of the front anchor link 18, it is possible to control the movement of the pivot 78 along the arcuate path 118 so that the movement will successively be in one direction and then in an opposite direction, while movement of the pivot 96 of the front anchor link is being moved in a single direction only. Thus, it will be seen that in the closed position of the frame sections the pivot pin 78 may be disposed at a point X, at a point Y in the intermediate position, and at a point Z in the open position. Moreover, the physical arrangement is such that it may be readily modified to vary the relative positions of the X, Y and Z points, if desired.

It will be apparent that by locating the position of the pivot 78 at the low point X of the arcuate path in the closed position, the previously stated objective B will be accomplished and that the rear portion of the closed bed frame in relation to the floor will be lower.

By locating the position of pivot 78 at the high point Y on the arcuate path 118 in the intermediate position, the previously stated objective A will be accomplished and that the floor clearance of the frame sections during their articulated folding and unfolding movements will be increased.

Also, by locating the position of the pivot 78 at the lower intermediate point Z on the arcuate path 118 in the open position, the previously stated objective C will be obtained and that the bed frame will be disposed at a more desirable position forward of the associated upholstered back-rest, and at a more desirable height above the floor.

Referring now to FIG. 6–9, the manner in which the unique arrangement and operation of the front anchor link 18 and the rear anchor link 20 is controlled by the connecting link 112, will now be described with respect to the attainment of the heretofore mentioned product features.

Figure 6:
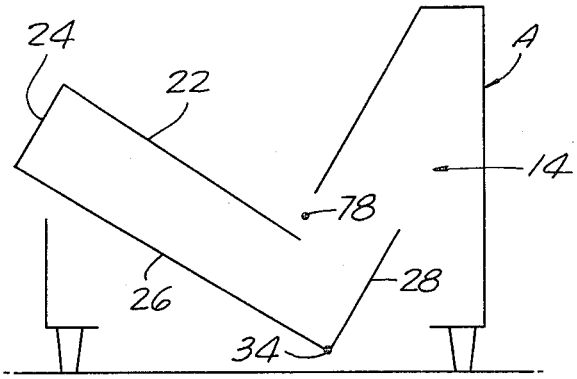
FIG. 6 is a view diagramatically illustrating the relative orientation of the bed frame sections of a typical mechanism which does not embody the present invention, when moved towards an intermediate position.
Figure 7:
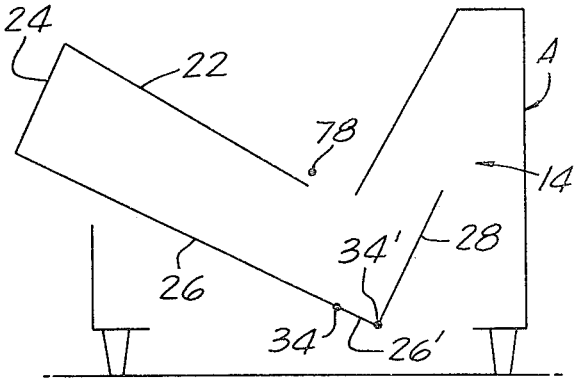
FIG. 7 is a similar view illustrating the manner in which the unique path of movement of the rear anchor link in the present invention increases the clearance of the lowest point of the bed frame from the floor; and permits lengthening of the body section rearwardly beyond its point of attachment to the linkage system in order to lengthen the open bed.

The manner in which the stated product feature No. 1 of being able to lengthen the bed frame structure, will become clearly evident from a consideration of FIGS. 6 and 7. As particularly shown in FIG. 6, in a typical mechanism which does not embody the present invention and wherein the pivot point 78 is fixed, when the body section 26 and head section 28 are pivotally connected by the joint pivot 34 at the outer end of the rear support link 82, a minimum floor clearance during the articulated movement will be obtained as the folded bed sections are moved towards an intermediate position. In the mechanism according to the present invention, as shown in FIG. 7, since the pivot 78, during movement of the bed frame from a closed to intermediate position, is moved upwardly and forwardly from the point X to the point Y, greater floor clearance will be provided, which is a desirable objective. Also, it is possible to obtain additional bed length by extending the body section 26, as indicated at 26', rearwardly of the pivot connection 34 and provide a new joint pivot 34' between the body section and head section.

Additional bed length can also be obtained by lengthening the head section 28. This is possible due to the additional clearance in front of the upholstered seat back, when the bed sections are in extended open position. As will be seen in FIG. 5, the pivot pin 78 is disposed at point Z in the open position of the bed frame, this point being forward of the closed position at point X. Because of this forward displacement distance, it is possible to lengthen the head section accordingly.

Figure 8:
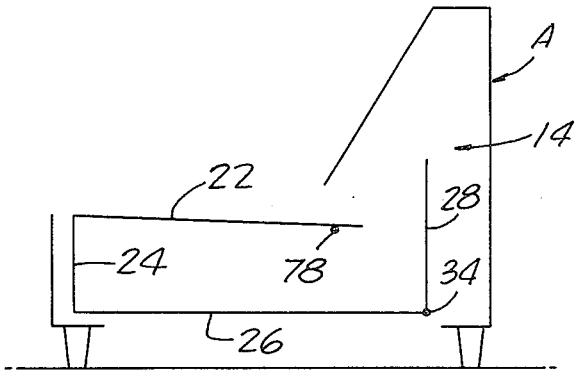
FIG. 8 is a view similar to FIG. 6 showing the relative orientation of the bed frame sections therein, when in a closed folded position.
Figure 9:
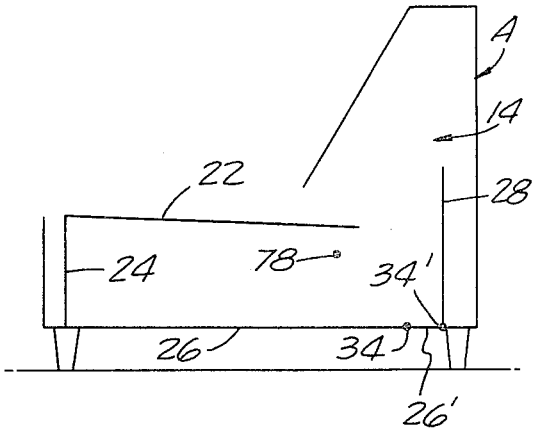
FIG. 9 is a view diagramatically illustrating the manner in which the unique path of movement of the rear anchor link in the present invention enables the cavity for the folded mattress to be increased in depth.

The manner in which the stated product feature No. 2 of increasing the depth of the mattress cavity of the folded frame structure and retaining a relatively low seat level with desired rake or pitch, will become clearly evident from a consideration of FIGS. 8 and 9. Since the pivot 78 in the closed position of the frame sections is positioned at the relatively lower point X, the bottom of the closed unit will be relatively closer to the floor. This will permit increasing the depth of the mattress cavity or space below the properly pitched sofa seat forming foot section 22.

An additional advantage is obtained in having the pivot point 78 of the rear anchor link 20 move forwardly and upwardly along the arcuate path 118 at a relatively rapid rate of movement as the frame sections are moved from closed to open position. Given this movement of pivot point 78, the head section 28, which is disposed in a generally vertical position in the closed position of the frame sections, can be located in closer proximity to the outside back of the sofa. Accordingly, as pivot point 78 moves quickly forwardly along the arcuate path 118 as the unit is opened, the unfolding head section of the bed can be made to clear the outside back of the sofa.

In contrast to the movement of the outer pivot point at the end of a swingable rear anchor link in the known prior structures, the present invention uniquely provides for accelerating that movement and for increasing the amount of such movement so as to clear the floor at the intermediate stage of articulation. The movement is then reversed to return the pivot point to a desired position for purposes of positioning the open bed.

From the structure thus far described, it will be apparent that additional bed length is possible over that which may be conventionally obtained in conventional sofa-bed structures. In the present invention, it has been discovered that by incorporating a simplified and unique modification of the previously described head section, it is possible to obtain a still further increase of the bed length. In seeking to accomplish this objective, however, it became evident that it would not be possible to simply increase the length of the head section 28 for the reason that it could not be accommodated within the confined space at the back of the sofa frame structure during a folding movement into a seat-forming position, and that the head section would stick out the back of the sofa frame. It was realized that this problem might be solved if the head section could be fabricated into two pivotally connected frame structures which would have a greater length than the single frame structure of head section 28, and provision made for the controlled actuation of the two sections into an angular orienated relationship which would permit its transitory movement within the confined backspace of the sofa frame structure during operative movements between the seat-forming and bed-forming positions of the mechanism.

Figure 11:
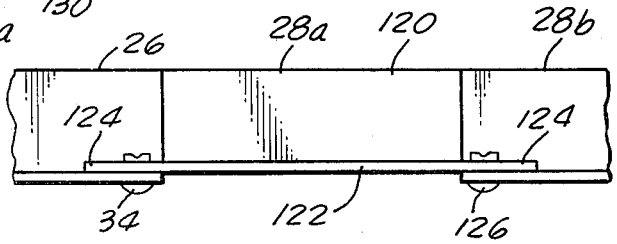
FIG. 11 is an enlarged top plan view as seen from line 11—11 of FIG. 10, and showing the two frame sections which combine to make up the modified head section.
Figure 12:
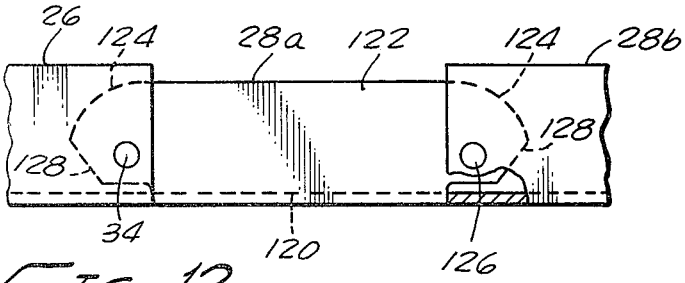
FIG. 12 is a side elevational view of the structure shown in FIG. 11 to show the coplanar relationship of the connected sections and the stop means for limiting their angular relationship in the folded positions.
Figure 13:
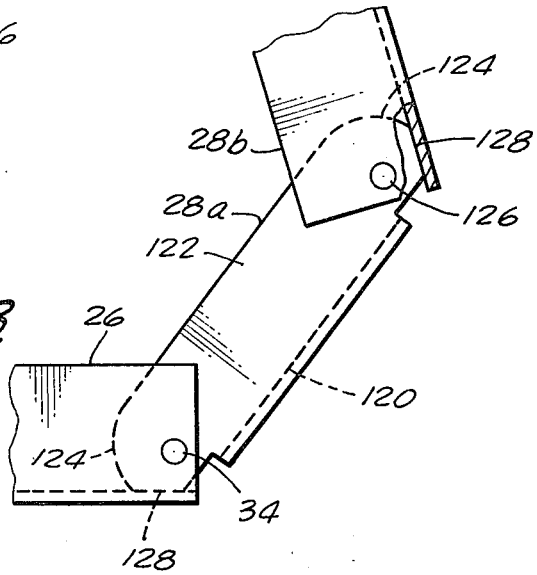
FIG 13 is a view similar to FIG. 12 showing angular relationship of the connected sections in the folded seat-forming position.

For such purpose, the single frame structure of the head section 28 has been fabricated to provide two pivotally interconnected frame sections 28*a* and 28*b*. In practice, this is accomplished by modifying the side rails which are formed of angle iron members. More specifically, as best shown in FIGS. 11 and 12, the side rails of the frame structure 28*a* are similarly formed in each case to provide a connecting link between the adjacent body section 26 and the head section frame structure 28*b*. The horizontal flange 120 has end edges which are adapted to abut the adjacent end edges of the horizontal flanges of the body section 26 and the head frame section 28*b*, when the sections are in bed-forming position. The opposite ends of the vertical flange 122 is provided respectively at its opposite ends with an extended end portion 124 to facilitate pivotal hinged connection with the vertical flange of the adjacent body section 26 by means of the pivot 34, and with the adjacent vertical flange of the head frame structure 28*b* by means of a pivot 126. Hinged movement of the interconnected sections into relative predetermined angular orientation, as disclosed in FIG. 13, is determined by the engagement of an abutment edge 128 on each of the end portions 124, with the adjacent surface of the horizontal flange of the associated frame section.

While the abutment edges 128 have been disclosed as being formed on the end portions 124, in each case, it will be appreciated that other types of stops may be employed, and that similar results might be accomplished by disposing the vertical flange 122 outwardly of the vertical flanges of the body section 26 and head sections 28*b* and the provision of abutment edges on extended portions of the vertical flanges of these sections.

Figure 10:
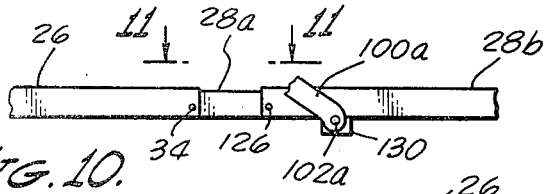
FIG. 10 is a fragmentary side elevational view of a modified head section structure for obtaining increased bed length.

In this modification, the head section actuating link 100 has been lengthened and is indicated at 100*a* in FIG. 10 as being connected with a tab 130 on the head section frame structure 28*b* by means of pivot 102*a*.

Figure 14:
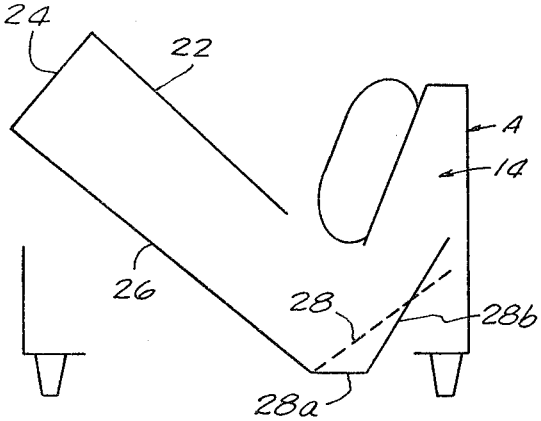
FIG. 14 is a view similar to FIG. 7 which diagramatically shows the relative orientation of the single and double section head sections as the mechanism moves towards an intermediate position.
Figure 15:
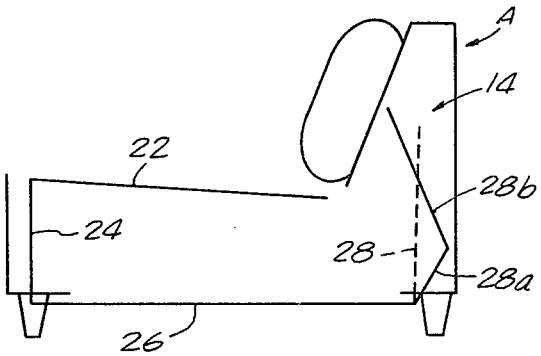
FIG. 15 is a view similar to FIG. 9 showing the orientation of the sections shown in FIG. 14, when the mechanism is in a closed position.

The comparative operational relationship between the head section 28 having a single frame structure and the head section having the two frame structures 28*a* and 28*b* is clearly shown in FIGS. 14 and 15. Thus, in FIG. 14 it will be observed that as the mechanism moves towards an intermediate position, the angular relationship of the frame structures 28*a* and 28*b*, as shown in full lines, is such that it does not project rearwardly beyond the single frame structure 28, as shown in dash lines. In the closed position of the mechanism, as indicated in FIG. 15, it will be noted that the angular relationship between the frame structures 28*a* and 28*b* is such that it may be nicely accommodated within the confines along the back portion of the sofa frame structure.

From the foregoing description and drawings, it will be clearly evident that the delineated objects, objectives and features of the invention will be accomplished.

Various modifications may suggest themselves to those skilled in the art without departing from the spirit and scope of the invention and, hence, it is not wished to be restricted to the specific forms shown or uses mentioned, except to the extent indicated within the appended claims.

I claim:

1. In a folding sofa-bed construction including a bed frame having a plurality of frame sections, one of which is an inner head section and another an adjacent body section, said sections being pivotally interconnected in end-to-end relation for selective unfolding movement to an extended coplanar bed-forming position and folding movement to a folded retracted sofa seat-forming position in which the body section is disposed generally horizontally along the base of the sofa frame and the head section extends generally upright in a space at the rear of the sofa seat, and mechanism for supporting and controlling the movements of said frame sections during movement of the bed frame to said extended and retracted positions, the improvement comprising:

an inner head section fabricated to provide two frame structures which are pivotally interconnected in end-to-end relation and the outermost of said frame structures is pivotally connected in end-to-end relation to the frame structure of the adjacent body section.

2. A sofa-bed construction according to claim 1, in which:

the supporting and control mechanism includes actuating link means connected with the innermost of the head section frame structures.

3. A sofa-bed construction according to claim 2, in which:

the body section and the two frame structures of the head section are connected for movement into relative angular orientation, whereby to provide an overall head section length in the folded seat-forming position that is less than the overall length thereof in the unfolded bed-forming position.

4. A sofa-bed construction according to claim 3, which includes:

stop means for determining said relative angular orientation of the body section and said two frame structures in the folded position.

5. A sofa-bed construction according to claim 4, in which:

the stop means comprises engageable abutment stops respectively at the pivotal connections of the two frame structures of the head section and the adjacent body section.

6. A sofa-bed construction according to claim 5, wherein:

said abutment stops are disengaged, when the two frame structures of the head section and the adjacent body section are in coplanar relationship, and are engageable in each case after a predetermined relative angular movement.

7. A sofa-bed construction according to claim 1, in which:

the body section and inner frame structure of the head section include side rails; and the outer frame structure of the head section comprises similar link members respectively having their opposite ends in each case pivotally connected with the adjacent side rail ends of said body section and said inner frame structure.

8. A sofa-bed construction according to claim 7, in which:

stop means at the pivoted opposite ends of each link member limits the relative movement in one direction of the connected body section and the connected inner frame structure of the head section to a coplanar orientation in the bed-forming position, and limits the relative movement thereof in an opposite direction to a predetermined angular orientation in the seat-forming position.

9. A sofa-bed construction according to claim 8, in which:

said link member has opposite end portions respectively projecting beyond the pivotal connection;

said projecting portion at one end of the link member being adapted to abut a portion of the side rail of the body section, and said projecting portion at the other end of the link member being adapted to abut a portion of the side rail of the inner frame structure, in the seat-forming position.

10. A sofa-bed construction according to claim 7, in which:

each link member comprises a side rail section.

11. A sofa-bed construction according to claim 10, in which:

the side rails of the body section, link and inner frame structure of the head section comprise elements having longitudinally extending sides in right-angled relation;

the pivotal interconnections are effected between adjacent ends of the same corresponding sides thereof; and in which the stop means at the respective pivotal interconnections includes an end extension of one of the pivotally connected corresponding sides at the pivotal connection.

12. A sofa-bed construction according to claim 11, in which:

the end extension at each pivotal connection is movable into enagement with the other side of the other connected side rail at said pivotal connection.

13. In a folding sofa-bed construction including a bed frame having a plurality of frame sections, one of which is an inner head section and another an adjacent body section, said sections being pivotally interconnected in end-to-end relation for selective unfolding movement to an extended coplanar bed-forming position and folding movement to a folded retracted sofa seat-forming position in which the body section is disposed generally horizontally along the base of the sofa frame and the head section extends generally upright in a space at the rear of the sofa seat, and mechanism for supporting and controlling the movements of said frame sections during movement of the bed frame to said extended and retracted positions, the improvement comprising:

(a) an inner head section having an expandable and contractable overall length;

(b) a stationary anchor frame plate;

(c) rear support linkage means pivotally connected between a rear pivot point on said anchor frame plate and a rear portion of said body section, said rear linkage means including an anchor link having a pivotal linkage suspension point of connection at its outer end and being pivoted at its inner end at said rear pivot point;

(d) front support linkage means pivotally connected between a front pivot point of said anchor frame plate and said body section forwardly of the connection to said rear support linkage means, said front linkage means including an anchor link having a pivotal connection at its outer end and being pivoted at its inner end at said front pivot point;

(e) means interconnecting said front and rear anchor links operative during a portion of the swinging movement of said front anchor link in one direction, in response to unfolding and folding movements of the frame sections, to actuate the rear anchor link in a swinging direction opposite to that of the front anchor link; and (f) actuating link means connecting the rear linkage means and said inner head section and being operative to effect a contraction of tne overall length of the head section in the seat-forming position.

14. A folding sofa-bed construction according to claim 13 in which:

the inner head section comprises pivotally interconnected inner and outer frame structures, the outer of which frame structures is pivotally connected to the adjacent body section; and the actuating link means interconnects the rear linkage means and the inner frame structure of the head section and is operative to orient the inner and outer frame structures of the head section in coplanar relation in the bed-forming position and into angular relation in the seat-forming position.

15. A folding sofa-bed construction according to claim 14, which includes:

stop means for respectively terminating relative angular movement between said inner and outer frame structures and said body section respectively upon their movement into the bed-forming and seat-forming positions.

* * * * *